US005341735A

United States Patent [19]

Hajek

[11] Patent Number: 5,341,735

[45] Date of Patent: Aug. 30, 1994

[54] ROTARY PRINTING MACHINE SYSTEM WITH SYNCHRONIZED MULTIPLE PRINTING MACHINE UNITS OR STATIONS

[75] Inventor: Josef Hajek, Friedberg, Fed. Rep. of Germany

[73] Assignee: MAN Roland Druckmaschinen AG, Offenbach am Main, Fed. Rep. of Germany

[21] Appl. No.: 108,064

[22] Filed: Aug. 17, 1993

Related U.S. Application Data

[63] Continuation-in-part of Ser. No. 917,831, Jul. 21, 1992, abandoned.

[30] Foreign Application Priority Data

Aug. 17, 1991 [DE] Fed. Rep. of Germany ..... 4127321

[51] Int. Cl.[5] ..... B41F 5/08; B41F 13/12

[52] U.S. Cl. ..... 101/181

[58] Field of Search ..... 101/181, 220, 219, 228, 101/178, 179, 180, 182–185, 136–140, 142–145; 318/5

[56] References Cited

U.S. PATENT DOCUMENTS

| | | | |
|---|---|---|---|
| 1,625,225 | 7/1925 | Seeger | 318/103 X |
| 1,640,977 | 8/1927 | Brueshaber | 101/219 |
| 1,970,491 | 8/1934 | Crafts | 101/220 X |
| 2,053,979 | 9/1936 | Tornberg | 101/220 |
| 2,423,028 | 6/1947 | Horton et al. | 318/103 X |
| 2,979,646 | 4/1961 | Rouse | 318/5 X |
| 3,221,651 | 12/1965 | Tagliasacchi | 101/183 |
| 4,240,346 | 12/1980 | Landis et al. | 101/181 X |

FOREIGN PATENT DOCUMENTS

| | | |
|---|---|---|
| 594086 | 3/1934 | Fed. Rep. of Germany . |
| 618892 | 9/1935 | Fed. Rep. of Germany . |
| 787464 | 9/1935 | Fed. Rep. of Germany . |
| 975145 | 9/1955 | Fed. Rep. of Germany . |
| 2406509 | 8/1975 | Fed. Rep. of Germany . |
| 2758900 | 10/1978 | Fed. Rep. of Germany . |
| 3031714 | 4/1982 | Fed. Rep. of Germany . |
| 146018 | 6/1931 | Switzerland . |

*Primary Examiner*—J. Reed Fisher

*Attorney, Agent, or Firm*—Frishauf, Holtz, Goodman & Woodward

[57] ABSTRACT

To facilitate expansion of modular printing units (1, 2, 3) and particularly vertical expansion into tower printing stations (1–4; 2–5; 3–6), each printing unit, with its own printing cylinder (20)and drive motor (8–13), has associated therewith a power take-off unit (14–19; 53–56) which, via a right-angle drive, synchronizes a horizontal synchronizing shaft (21) with individual vertical synchronizing shafts (22, 23, 24) of two-tier or two-level or tower printing stations. The power take-off units include continously engaged gears, including bevel gears (79, 80, 81) coupling together the synchronizing shafts and, additionally, coupling a clutch part (76, 78) of the power take-off unit, so that, upon engagement with a second clutch part (77, 75), the synchronizing shaft, individual drive motors (8–13) and the printing cylinder can be coupled together or, upon disengagement of the clutch parts, the motor can drive the individual printing cylinder, independently of synchronized continuous rotation of the horizontal and vertical synchronizing shafts (21, 22–24).

13 Claims, 8 Drawing Sheets

ROTARY PRINTING MACHINE SYSTEM WITH SYNCHRONIZED MULTIPLE PRINTING MACHINE UNITS OR STATIONS

The present application is a continuation-in-part of U.S. Ser. No. 07/917,831, filed Jul. 21, 1992, now abandoned.

Reference to related patents, the disclosures of which are hereby incorporated by reference:

U.S. Pat. No. 1,625,225, Seeger et al.

U.S. Pat. No. 4,240,346, Landis et al.

Reference to related publications:

German Patent 594,086

German Patent 975,145, Bayer

German Patent 30 31 714, Marz

Swiss Patent 146,018.

FIELD OF THE INVENTION

The present invention relates to a printing machinery system, and more particularly to a drive system for a rotary web printing machine system in which a group of printing units are arranged in series, and some of the printing units are placed on top of each other to form tower-type printing stations, and in which the printing units are synchronized to form a coordinate printing machine system in a modular arrangement which permits multiple paper web paths.

BACKGROUND

Rotary printing machines, and particularly web-type rotary printing machines, usually are driven by a horizontal main drive shaft. This main drive shaft is retained in bearings and has transmission elements to drive the individual printing machine units or stations. The transmissions have individual drive motors associated therewith and clutches permit, selectively, engagement or disengagement of the individual printing machine units with the main drive shaft. The printing machine units, thus, can be driven independently from each other by the individual drive units so that some drive units which are not clutched-in can have service or make-ready operations associated therewith. Usually, energy transmission of the drive motors to the main drive shaft is obtained by gears, toothed or gear belts, or by flat belts. The energy is then transmitted over vertical or horizontal shafts, coupled from the motors by bevel gears or the like for engagement with the respective printing machine units. The main drive shaft also functions as a synchronizing shaft for those printing machine units which are coupled thereto.

German Patent 975,145, Bayer, assigned to a predecessor company of the assignee of the present application, shows a drive for a rotary web-fed printing machine in which individual printing stations are serially arranged. The printing machine units or stations have individual electric motors associated therewith, which are coupled to a plurality of main drive shafts. The individual printing units are driven by vertical drive shafts which can be selectively coupled to the main drive shaft. The arrangement permits selectively stopping printing units, including accessory or auxiliary apparatus, while the inkers continue to rotate. This arrangement is not suitable for vertically stacked printing machine units or printing towers because it is too expensive and requires a substantial number of equipment components.

U.S. Pat. No. 4,240,346, Landis et al., describes a drive for a rotary web press printing machine which is serially constructed, in which each printing machine station has a drive motor associated therewith which can be connected to a horizontal main drive shaft by a suitable clutch.

When printing machine stations are located above each other, the drives with horizontal and vertical shafts require substantial numbers of drive wheels or gears. Use of a large number of drive wheels or gears, intermediate gears and the like, particularly bevel gears, results in play which causes difficulties to maintain register within an entire machine system built of a plurality of printing machine units, and results in register errors which can be corrected only with great difficulty and require apparatus of extreme accuracy.

THE INVENTION

It is an object to provide a printing machine system which is suitable for web-fed rotary printing machine units, especially an offset printing machine system, which can be used with selectively operating printing machine units of tower printing machine stations. The printing units are aligned in a horizontal row as well as, selectively, placed one unit above another, to permit the space-efficient tower construction. It should be possible to drive individual units separately and, most importantly, to reduce the number of drive gears so that play in gearing, and hence errors in register, is substantially reduced; the printing units should be so arranged that any one unit can be individually severed from the system without affecting any other unit therein, or the synchronization and coordination of any still connected printing unit, or units in the system.

Briefly, each printing unit has an individual drive motor coupled to a printing cylinder of the respective unit. A power take-off unit, or assembly, which can include a minimum number of gears, is provided. The power take-off unit is coupled to the shaft of the printing cylinder. The power take-off unit includes a clutch. The synchronizing shaft system includes a horizontal synchronizing shaft, or shaft sections, for the lower printing units and a vertical synchronizing shaft, or shaft portions, for the upper unit of a tower station. The power take-off unit includes a gearing connection for the vertical synchronizing shaft coupling it via a gearing connection to the horizontal synchronizing shaft. The vertical synchronizing shaft couples together the lower one and the upper one of the printing units of one power station. Thus, providing the shafts in form of synchronizing shafts, in which the individual units can be coupled together to provide any desired groups, permits many different possibilities of production. The power take-off unit further includes a clutch for selective coupling of the respective printing unit and its printing cylinder, or cylinders, and an associated motor to the synchronizing shaft system.

The printing machine units both have an individual drive motor and an individual power take-off units or assemblies, deriving power from the drive motor and selectively engageable with the respective synchronizing shaft to thus form modular units of a modular system. The power take-off assemblies can all be identical. The printing units of the printing stations are coupled together or correlated by the horizontal shaft and the vertical shafts which are coupled to the power take-off units, to provide for synchronization. Directly associating the power take-off units with the vertical shafts additionally eliminates bevel gears which are located outside of the printing machine units or stations, respectively, thus eliminating holding brackets and the like for such external drive shafts, and their associated gearing.

DRAWINGS

DETAILED DESCRIPTION

Figure 1:
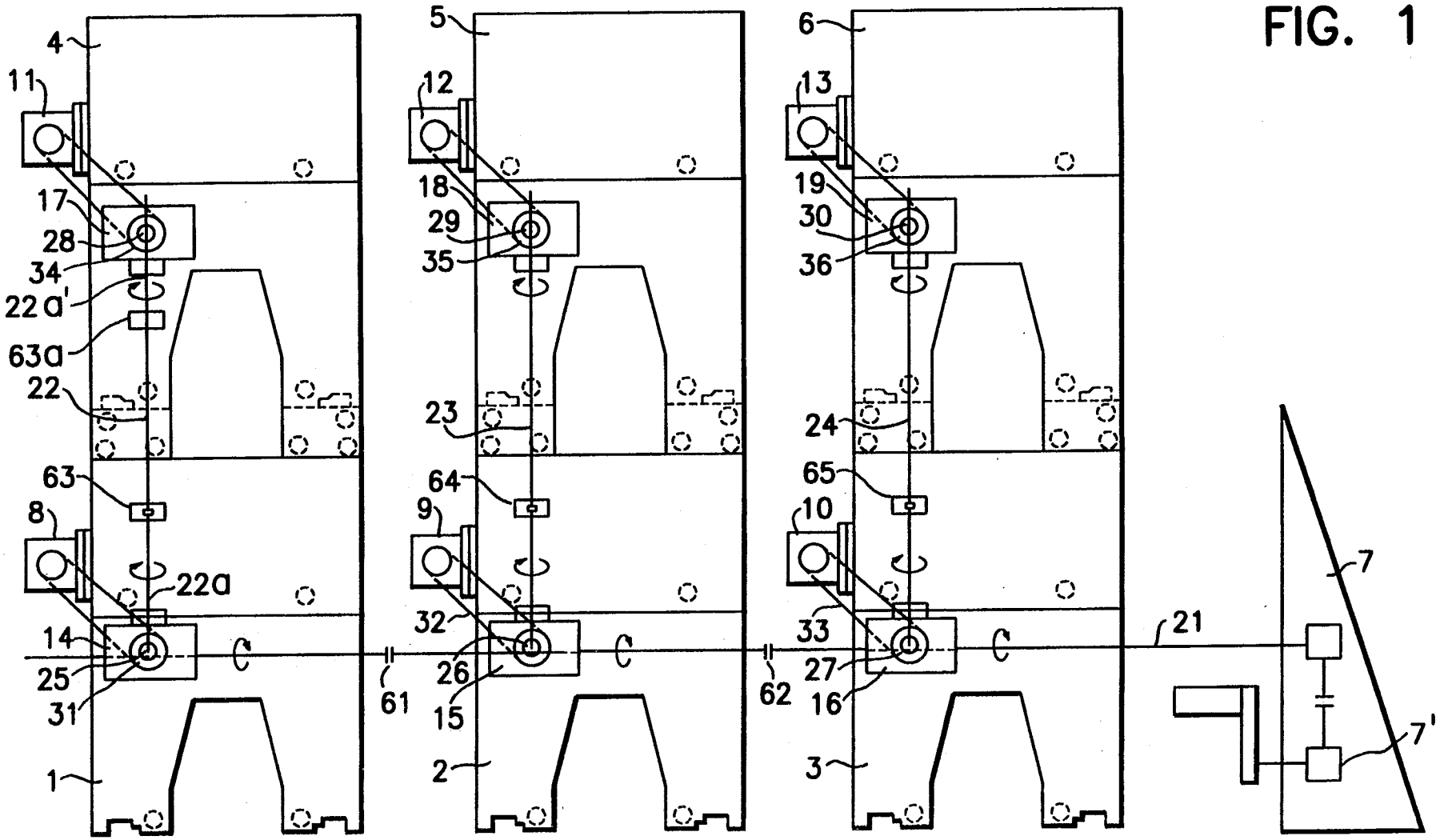
FIG. 1 is a highly schematic front view of a rotary printing machine system in which upper stations are located above associated lower stations.

Referring first to FIG. 1:

The printing machine system includes six printing stations having printing units 1, 2, 3, 4, 5, 6. Two printing machine units 1 and 4, 2 and 5, and 3 and 6, respectively, are located vertically above each other, in multiple-tier or multiple-level or tower arrangement. A folder or folding apparatus 7 is also shown. Each one of the printing machine units 1–6 has an individual drive motor 8–13, and a power take-off assembly 14–19.

A horizontal shaft 21 (FIGS. 1 and 7), providing for system synchronization, is located along the printing machine units 1, 2, 3, in the first or lower tier or level. The upper-level units 4, 5, 6 of the double-level printing units 1–4; 2–5; 3–6 are coupled to the lower-level units 1, 2, 3, respectively, by vertical synchronizing shafts 22, 23, 24 which, in the power take-off units, are coupled to the horizontal synchronizing shaft 21.

Each printing machine unit has a printing cylinder 20 (FIG. 7) carrying a printing image. This may be a single printing cylinder or either the plate or blanket cylinder of an offset printing machine unit. Each printing cylinder 20 of each of the stations or units 1–6 (FIG. 7) has a drive wheel 25, 26, 27, 28, 29, 30 associated therewith, which is located in or on the respective power take-off assembly 14–19. Each power take-off assembly 14–19 is coupled by a respective drive belt 31, 32, 33, 34, 35, 36 to the respective drive motor 8–13. Each wheel 25–30 within the power take-off assembly 14–19 can be engaged by a synchronizing, single-position clutch, for example a claw or jaw clutch, to the respective horizontal and vertical shafts 21, 22, 23, 24. Such claw or jaw clutches typically have axial clutch engagement elements which can be moved, respectively, between engaged and disengaged positions. This permits, selectively, coupling a printing cylinder 20 of any one of the printing units 1–6 and its individual drive motor 8–13 via the power take-off unit 14–19 to the synchronizing shaft or shafts 21, 22, 23, 24 of the system, or, selectively, disengaging power transmission and the printing cylinder 20 of any one unit, to permit individual drive of the respective printing cylinder, for example in a creep mode for make-up or the like. Single position clutches, such as jaw or claw clutches, and other positive angular position clutches are well known in the printing machinery drive field and any suitable arrangement may be used. Such clutches provide for positive relative angular positioning of the respective shafts coupled to the clutch portions. The respective printing machine units 1–6 have the usual auxiliary apparatus, such as inkers and/or dampeners, well known in the printing machine industry, and not further shown or described. Any suitable inker or dampener arrangement may be used. The drive for the inkers and dampeners, as well as the drive of an additional printing cylinder, for example a blanket cylinder, is obtained by a gear train which derives its drive from that one of the printing cylinder 20 which is coupled to the associated motor. This cylinder can thus be termed a main driven printing unit cylinder. This main driven printing unit cylinder, in an offset machine, may be either the plate cylinder or the blanket cylinder; preferably, it is the plate cylinder.

In accordance with a feature of the invention, the horizontal shaft 21 and the vertical shafts 22, 23, 24 operate as synchronizing shafts, and are continuously coupled together. All the shafts, that is shafts 21, 22, 23, 24, can be separated into shaft units or shaft portions by suitable couplings or clutches 61, 62, 63, 63*a*, 64, 65 to separate the individual printing machine units (1–6); the couplings can also be used to couple together stub shafts, such as stub shafts 22*a*, 22*a*′ (FIG. 7) extending or forming part of the take-off units or assemblies. All power take-off units or assemblies can be constructed to be identical and connected or disconnected, as need be in a system, by extension shafts. The couplings, as well known in the printing machinery field, should be positive engagement couplings, so that the relative angular position of the coupled shaft portions will be predetermined. The couplings or clutches can be electromechanically, pneumatically or hydraulically operated.

The drive, as described, provides for synchronized drive of the individual printing machine units of the tower stations, and for positioning the respective units in register. Each one of the units 1–6 can be disconnected, individually, and resynchronized independently from the remainder of the printing machine units and their interconnections in the system, without interfering or interrupting with the synchronizing drive of any of them, or of any auxiliary apparatus, for example to a folding apparatus 7. FIG. 1 clearly shows that the horizontal shaft 21 extends to the folder 7 which is driven by its own motor and the power take-off assembly 7′, or through a suitable clutch which may be similar to any one of the clutches or couplings 61–65, for example.

Figure 2:
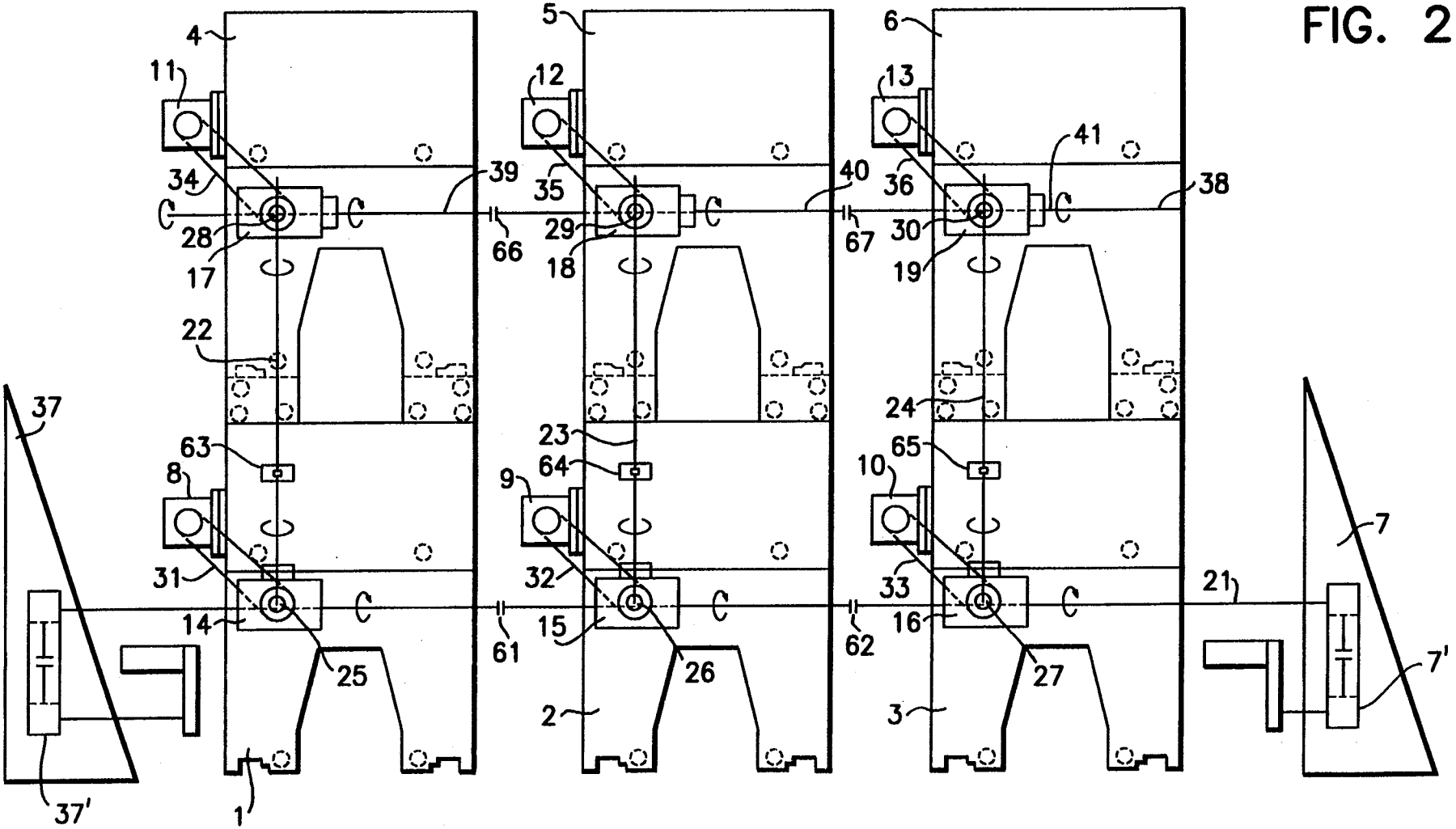
FIG. 2 is a view similar to FIG. 1 illustrating another arrangement.

FIG. 2 illustrates another embodiment, which is basically similar to the embodiment of FIG. 1. A second folding apparatus 37 with its own drive motor and power take-off unit or assembly 37′ is coupled to the shaft 21. Further, FIG. 2 illustrates a second horizontal synchronizing shaft 38 for the upper printing units or stations 4, 5, 6 in the second or upper-level tier. Second horizontal shafts 38 can be subdivided into portions 39, 40, 41. These portions interconnect the printing units 4, 5, 6 with adjacent printing units. The portions 39, 40, 41 of the shaft 38 can be coupled to the power take-off units or assemblies 17, 18, 19. These assemblies include bevel gears. The upper horizontal shaft 38 can be connected as a continuous shaft by engaging couplings or clutches 66, 67, which separate the shaft 38 into the portions 39, 40, 41. The couplings or clutches can be operated by fluid pressure, for example pneumatically, or electromechanically, as desired.

The embodiments of FIG. 2, including the upper horizontal shaft 38, permits vertical splitting of paper guidance, that is, effectively a diagonal paper path between the printing units 1–6 of the system. Paper webs can be fed simultaneously to the individual folding apparatus units 7, 37, as illustrated in respective different paper paths in FIGS. 3 and 4.

Figure 3:
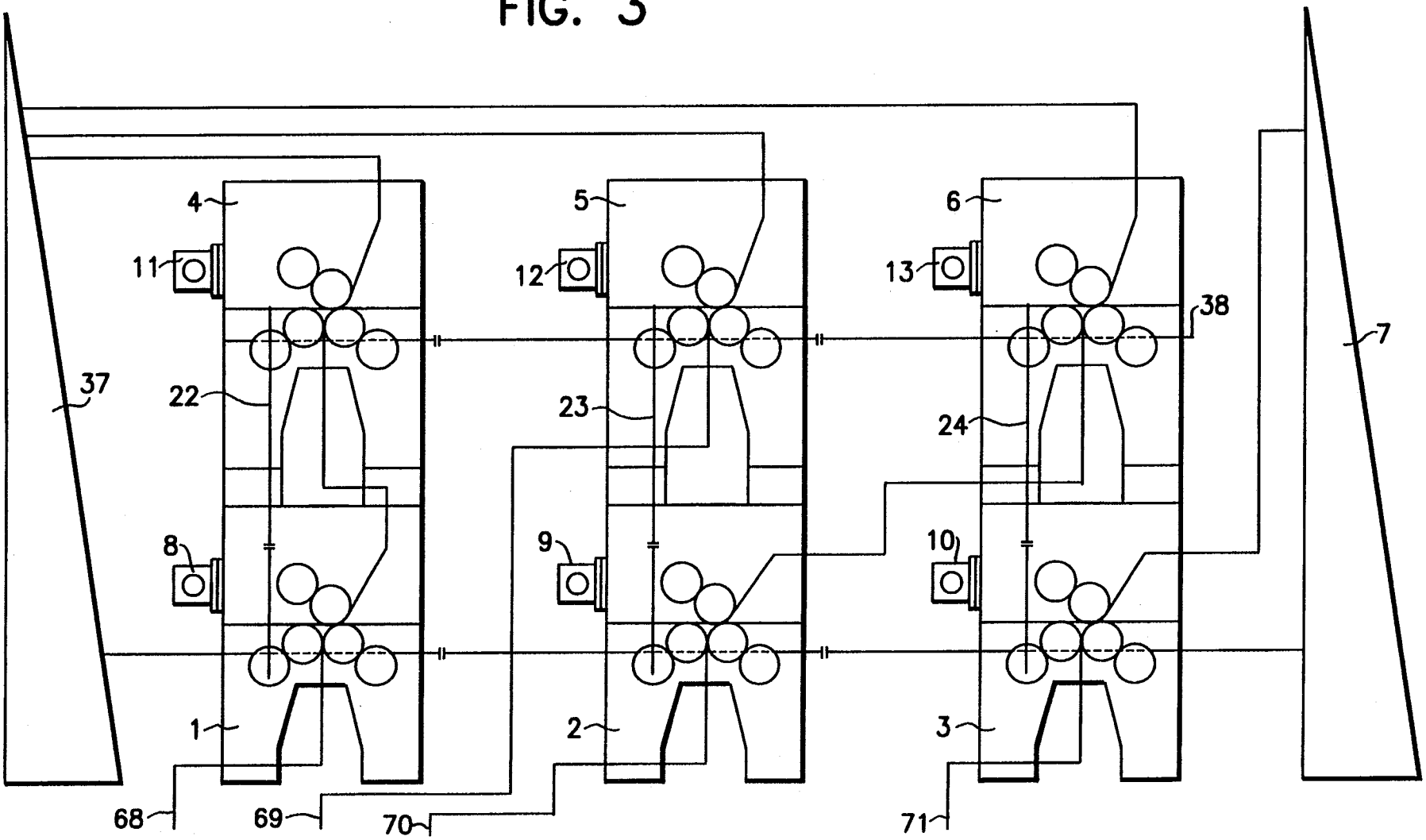
FIG. 3 is a schematic view of the system of FIG. 2 and illustrating one possible printing web path.

The paper path of FIG. 3 provides for a vertical upward path of a first web 68 passing through units 1 and 4 and then to folder 37. A second paper web 69 is guided vertically to the upper-level printing unit 5 and from there to the folding former 37. A third web 70 passes to the lower printing station 2 and then to the upper printing station 6, to be then guided to the former 37. A further web 71 is guided directly from the printing unit or station 3 to the folding former 7.

Figure 4:
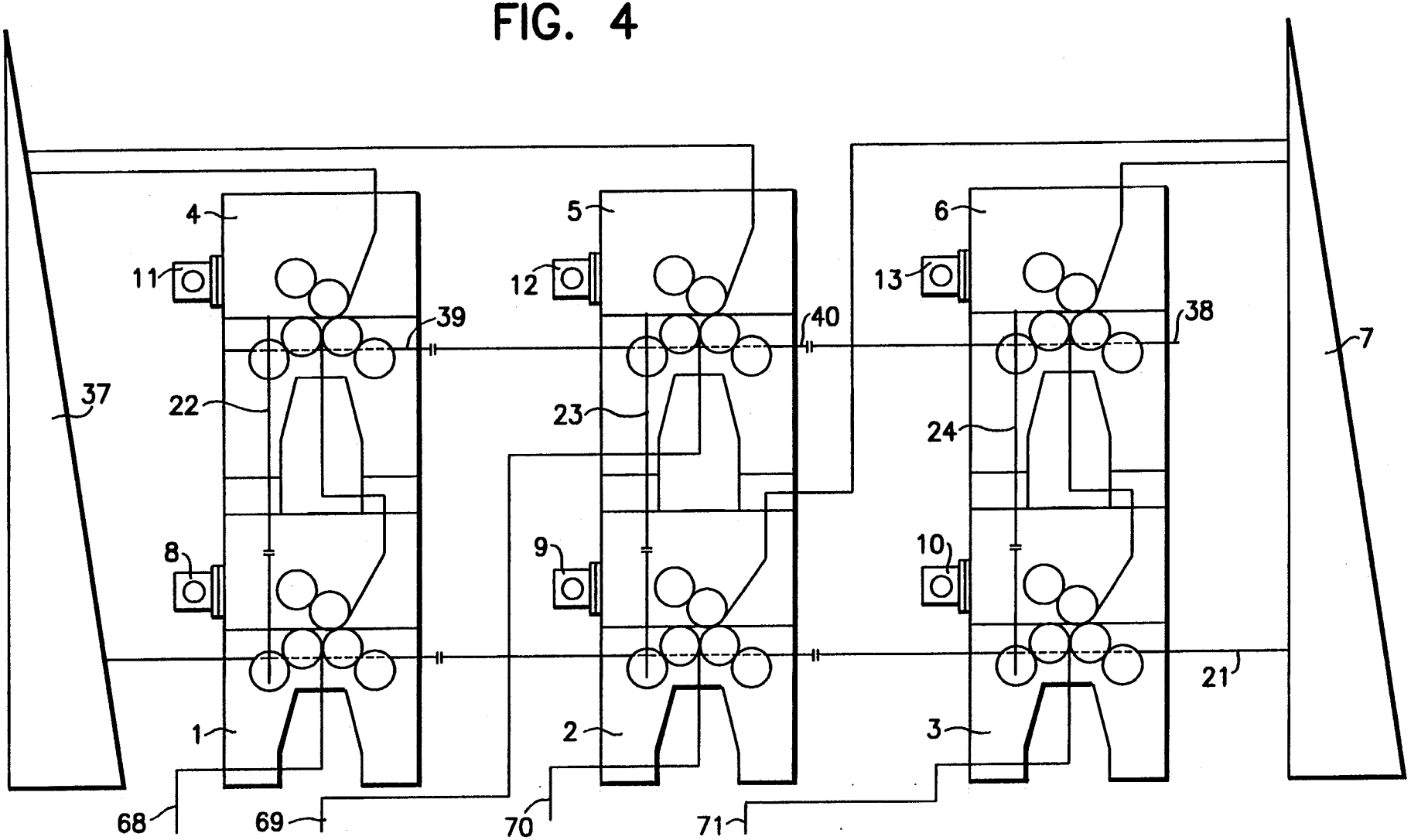
FIG. 4 is a view similar to FIG. 3 and illustrating other printing web paths.

The same machine can be threaded differently to obtain different production of printed matter—see FIG. 4. The first web 68 is passed, as before, straight upwardly through units and 4 to the folder 37. The second web 69 is guided directly to the upper-level unit 5, and then to the folding apparatus or folding former 37. The paper web 70 is guided in a diagonal path first through the lower-level unit 2 and then directly to the folding former 7. A further web 71 is guided vertically through the lower-level unit 3 and then to the upper-level unit 6 to the folding unit or apparatus 7.

Figure 5:
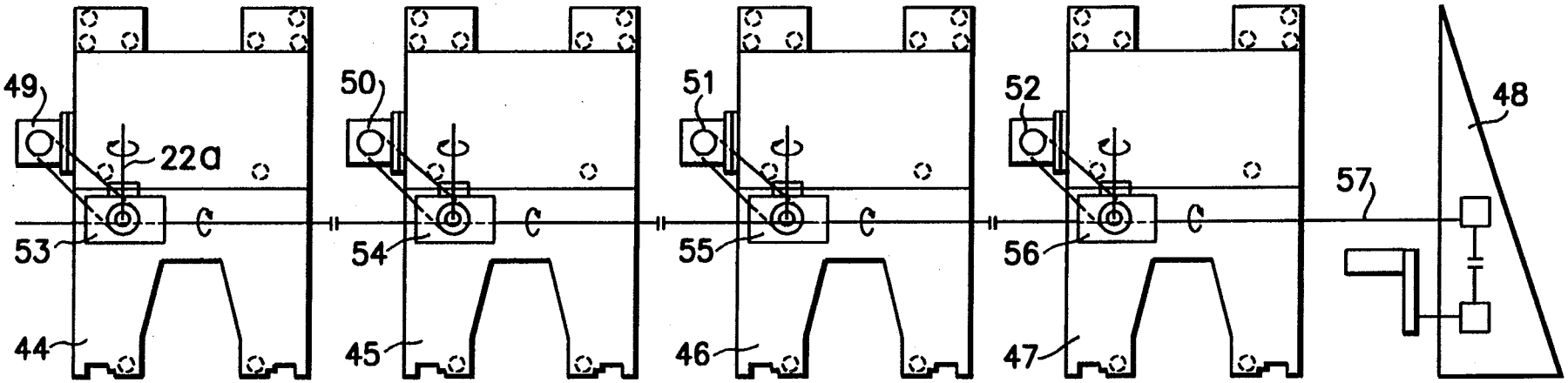
FIG. 5 is a view of a simplified in-line printing machine system in accordance with the present invention.

Various printing machine systems are first delivered with units only on a single level, but intended for future horizontal as well as vertical expansion, for example to multiple-level stations or tower arrangements. FIG. 5 illustrates an embodiment of the present invention in which single-level serial printing machine units or stations are synchronized by a synchronizing shaft and in which four printing stations 44–47 each have individual drive motors 49–52. The four printing stations 44–47 provide printing on a web 57 to a folding former 58. Power take-off units or assemblies 53–56 are driven by the respective motors 49–52, and are coupled to the respective printing station main driven printing unit cylinder. The horizontal shaft 57 couples the printing stations 44–47 into a synchronized coordinated system. The main driven cylinder 20 can be the plate cylinder or the blanket cylinder, if the printing stations 44–47 operate on the offset printing principle, preferably the plate cylinder.

Figure 6:
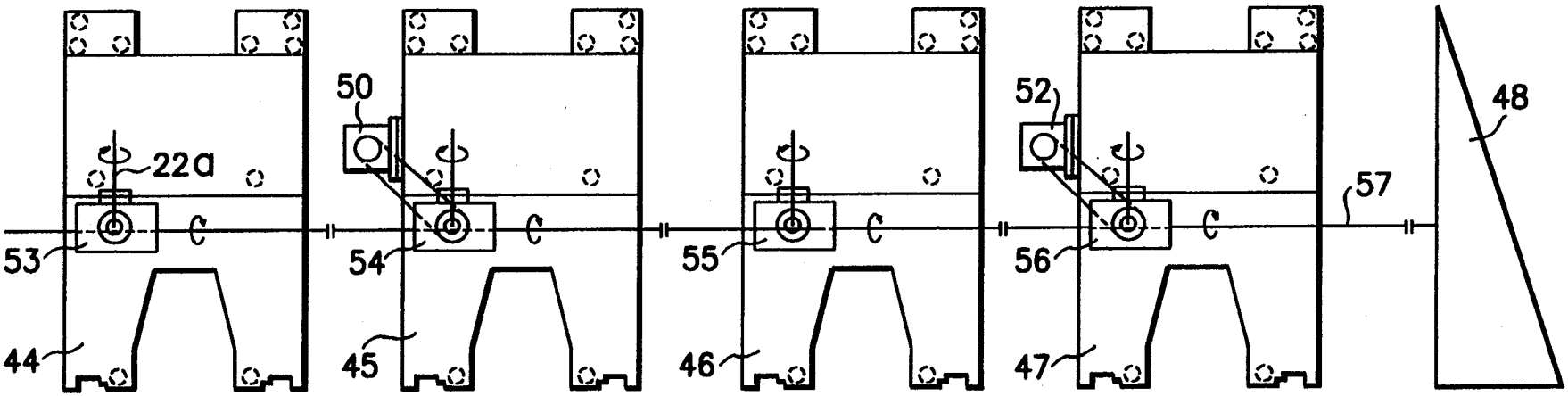
FIG. 6 is a schematic view illustrating another embodiment in which printing machine units are driven in tandem.

In some installations, it is not necessary to provide an individual drive motor for each printing station. FIG. 6 illustrates an embodiment in which two adjacent printing stations have one motor 50, 52. Rather than having single drive motors for each units, paired drives of the printing units 44–47 can be used. Of course, the motors 50–52 must be of sufficient power to operate two printing units rather than a single one. FIGS. 5 and 6 also show system expansion connections from the power take-off assemblies 53–56 to future upper-level stations. To expand the system, for example by expanding the unit 44 by placing a second unit on top thereof, as illustrated by unit 4 in FIG. 1, it is only necessary to provide a coupling shaft 22, another coupling unit **63*a* (FIG. 1), and connect the stub shafts 22*a*, 22' of the respective power take-off units 53 (FIG. 5) and 17 (FIG. 1**) together.

Figure 7:
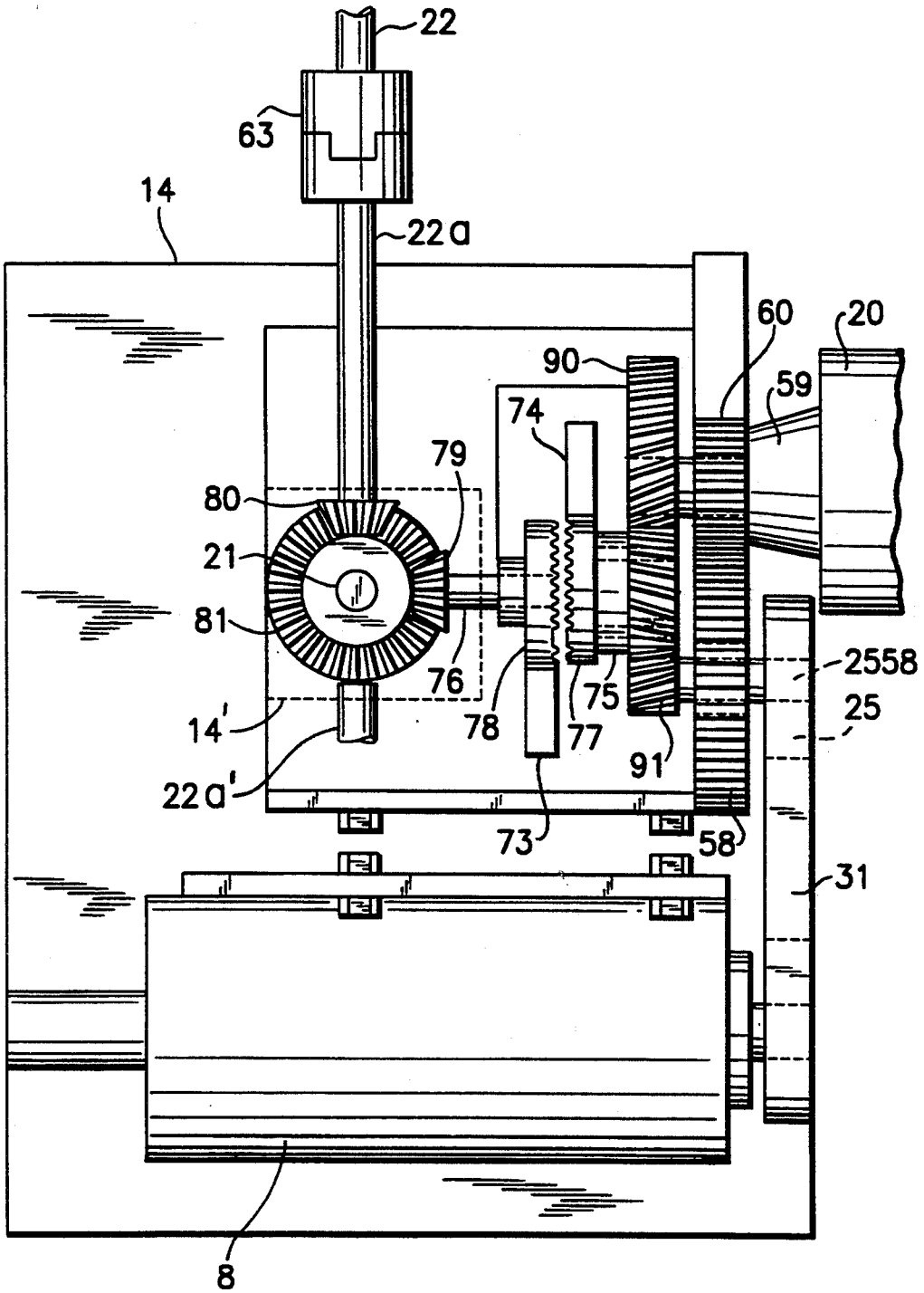
FIG. 7 is a highly schematic front view of a power take-off unit or assembly and drive of a printing cylinder with a drive motor.

All the printing units or stations can be identical, and the power take-off units likewise can be identical. FIG. 7 illustrates, in side view and highly schematically, the power take-off unit for any one of the printing units heretofore described, for example printing units 1, 2, 3, 4, 5, 6, or units 44–47. Bearings, support and framing structures and the like have been omitted from FIG. 7 for clarity. Their placement is a matter of routine engineering.

FIG. **7*a*** is a schematic representation of the flow of rotary power, in which the components are shown highly schematically.

Referring now to FIGS. 7 and **7*a*:**

The drive motor 8 is coupled by a drive belt 31 to a drive wheel or pulley 25 coupled to printing cylinder 20. Drive wheel 25 is secured on a shaft 2558, shown in broken lines in FIG. 7, to which a gear 58 is secured. Gear 58 is in engagement with a gear 60. Gear 60, in turn, is secured to the printing cylinder shaft 59, to which the printing unit cylinder 20 is attached. Therefore, power is transmitted from motor 20 via belts or belt 31, drive wheel 25, shaft 2558, and gears 58–60 to cylinder 20.

A spiral or helical gear 90 is secured to printing cylinder shaft 59, to rotate therewith. Gear 90 is in meshing engagement with a spiral gear 91. Spiral gear 91 is not seen in FIG. 7 in its entirety because a portion of it is below the plane of the drawing of FIG. 7. The power flow is schematically shown in FIG. **7*a***.

FIG. 7 also shows a positive engagement clutch 72, permitting only synchronized engagement and disengagement of clutch shafts 75, 76. The clutch 72 provides for synchronization of cylinder shaft 59, and hence of cylinder 20 of the respective unit 1–6, with the horizontal synchronizing shaft 21, or 38, respectively, as well as with the respective vertical shafts 22–24, when the clutch parts are engaged. The clutch parts can be operated by clutch positioning elements 73, 74. The clutches 72 can be so shaped that, simultaneously, they form overload-protecting clutches, as well known in this field. In the highly schematic illustration shown in FIG. 7, the clutch part 77, which is coupled to shaft 75, and operated by element 74 and, via gears 91 and 90, is continuously rotationally coupled to the printing cylinder shaft 59 and hence to the cylinder 20. The clutch part 78 is permanently rotationally coupled to shaft 76 and through a right-angle or bevel gear 79 to a synchronizing shaft, in FIG. 7 to the horizontal synchronizing shaft 21. The clutches 72 are positive, angularly determined engagement clutches. Clutches of this type are known as claw clutches or jaw clutches.

Figure 7A:
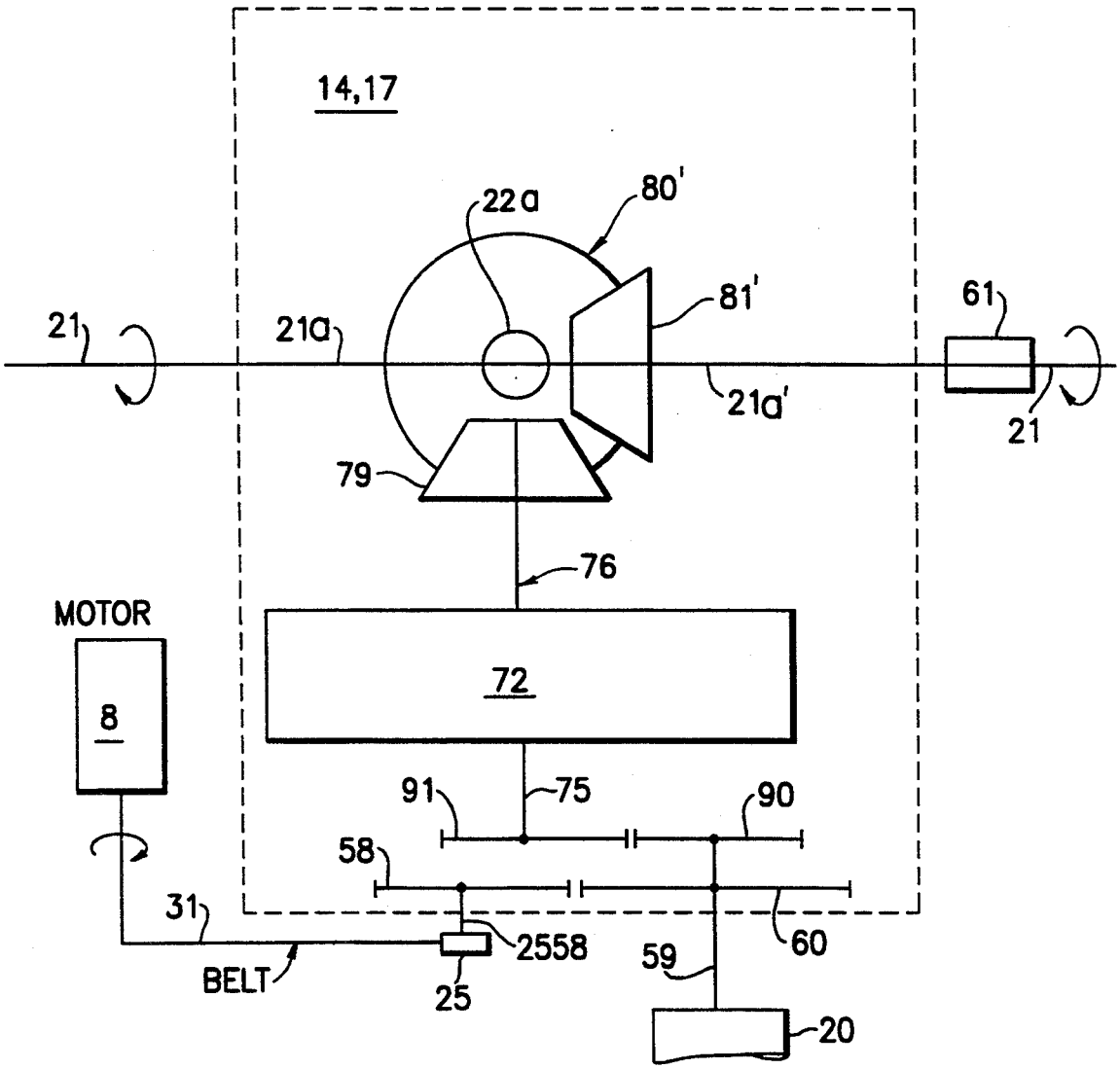
FIG. 7*a* is a schematic diagram showing rotary transmission flow through the power take-off unit or assembly.

The direct association of the drive motors 8–13 to the power take-off units of the printing units 1–6 including the integrated vertical shafts 22, 23, 24, via stubs **22*a* and 22*a*' permits placement of gearing for all the vertical shafts, that is, the gearing 79, 80 and a gear 81 coupled to horizontal synchronizing shaft 21 within the power take-off unit itself so that no external bevel gearing or any other external gearing need be located outside of the housing structures of the printing stations or units. This results in substantial decrease in register error. The power take-off units or assemblies of the upper and lower printing units can be identical, or similar. For an upper printing unit, for example printing unit 4 (FIG. 1), the power take-off unit shown in FIG. 7 need be modified only in that the lower stub shaft 22*a*' and in line with the stub shaft 22*a*, is extended, and the coupling 63*a* (FIG. 1) is used to provide a through-shaft connection 22 from the lower power take-off assembly 14 via stub 22*a* to the stub 22*a*' of the power take-off unit 17. In the upper unit 4, the bevel gear 81 coupled to stub shafts or shaft elements 21***a*, 21*a*′ which are coupled to or integral with shaft 21 in the lower unit, can be used to transfer power from the vertical shaft stub 22*a*′ to the clutch shaft 76 of the upper power take-off unit, by retaining the gear 81 on stub elements. If an upper synchronizing shaft 38 (FIG. 2) is used, gear 81 is then connected to the upper synchronizing shaft 38. FIG. 7*a* shows an alternative arrangement, in which the gear 80′ is coupled to the stub shaft 22*a*, or 22*a*′ respectively, and gear 81′ coupled to shaft 21, via stubs or portions 21*a*, 21*a*′ or similarly to shaft 38, if present, is connect to a bevel pinion 81′. In that arrangement, the bevel pinion 81′ and portions 21*a*, 21*a*′ can be omitted, if the upper units 4, 5, 6 are not connected through a synchronizing shaft 38. The right-angle transmission itself is shown as a unit 14′ outlined in broken lines in FIG. 7 since it may form a subassembly within the power take-off assembly 14 or 17, respectively (FIG. 7*a*).

Various paper paths are possible, and multiple paper paths to different formers can readily be arranged; the examples shown are only illustrative of some possibilities. Web guide rollers, bustle rollers, bearings, and other equipment well known and used in the printing machinery field, have been omitted from the drawing for clarity for clarity or have been shown only schematically.

FIG. 7*a* clearly shows the basic concept, namely that there is a continuous synchronizing drive available for power units between the horizontal main synchronizing shaft 21 and the individual vertical synchronizing shaft 22, through the stubs or shaft portions 21*a*, 22*a*. Each unit is synchronized, thus, by coupling the synchronizing gear 79 of the individual unit to the drive shaft 59 of the associated respective cylinder 20. This connection, however, can be selectively interrupted within the power take-off assembly by the clutch 72, to permit, for example, creep or slow drive of the cylinder 20, without in any way affecting the drive of any other unit in the system. If, for example, the unit 1 of FIG. 1 is decoupled by disengaging clutch 72, synchronized drive of the upper unit 4 of the printing station 1, 4 will be maintained, as well as synchronized drive of all the other units coupled to the shafts 21, 23, 24. This is obtained with a minimum number of gears in the power take-off unit as such. Gears 58, 60 are usually used, although not strictly necessary. Gears 90, 91, preferably spiral gears, are usually present in printing machines anyway. The individual association of the respective units and the entire system, thus requires practically only the right-angle drive system between gear 79 from clutch shaft 76 and gear 80 of the vertical shaft 22 which, in turn, is coupled to gear 81 of shaft 21. Other gearing arrangements are possible within the basic concept of providing one synchronizing shaft system which includes both the horizontal synchronizing shaft 21, as well as individual vertical synchronizing shafts 22–24 coupled together in power take-off units 14–19, and selectively engageable or disengageable drive connections to the printing cylinder 20 and the motor 8 of the individual printing unit, all within the integrated power take-off unit or assembly. This arrangement permits modular construction of systems, which thus can be associated in any desired way, with ready possibility of expansion, when needed.

Various changes and modifications may be made, and any features described in connection with any embodiment may be used with any other within the scope of the inventive concept.

I claim:

1. Rotary printing machine system with a plurality of synchronized printing machine units (1–6; 44–47), at least one of said units (4, 5, 6) being located above another one of said units (1, 2, 3) to thereby define upper units (4, 5, 6) and lower units (1, 2, 3), and an upper and a lower unit together defining a tower printing station, each of said units having a printing cylinder (20) carrying an image to be printed, and a printing cylinder shaft (59) coupled to the printing cylinder;

at least one horizontal synchronizing shaft (21, 38, 57) extending through the plurality of said lower machine units (1, 2, 3);

a vertical synchronizing shaft (22, 23, 24) coupling together the lower and upper printing units of a tower printing station (1, 4; 2, 5; 3, 6), said synchronizing shafts (21, 38, 22, 23, 24) coupling the units together into a synchronized, coordinate printing machine system, wherein, in accordance with the invention, each printing machine unit has an individual drive motor (8–13) directly associated therewith, said motor having a motor shaft which is mechanically coupled to the printing cylinder shaft (59) of the printing cylinder (20) of the unit in combination with an individual power take-off unit (14–19; 53–56) directly associated with each printing machine unit, said power take-off unit including a right-angle drive transmission (14) having means (81–80) for coupling the horizontal synchronizing shaft (21, 38) via a right-angle drive to the vertical synchronizing shaft (22, 23, 24) of the printing unit for synchronizing the lower and upper units of a tower station; and means (81–79; 72) for positively, selectively coupling or uncoupling the motor drive shaft of the individual drive motor (8–13) of the unit, and hence the printing cylinder shaft (59) of the printing cylinder, to or from said right-angle drive transmission and hence from both the horizontal synchronizing shaft (21, 38, 57) and the vertical shaft (22, 23, 24) of the printing machine unit, whereby the vertical synchronizing shaft (22, 23, 24) of said tower station (1, 4; 2, 5; 3, 6) will be in continuous synchronous driving engagement with the horizontal synchronizing shaft (21, 38) while permitting selective individual engagement or disengagement of the printing cylinder shaft (59) of any one printing cylinder (20) and the drive motor (8) coupled thereto of any one unit to or from the synchronized, coordinate printing machine system; and wherein the power take-off units of the printing machine units of the printing machine system are essentially similar.

2. The system of claim 1, wherein the printing units are offset printing machine units having at least one plate cylinder and at least one blanket cylinder; and wherein the respective drive motor (8–13) is in directly coupled driving connection with the plate cylinder of the associated printing unit.

3. The system of claim 1, wherein the right-angle drive transmission of the power take-off units (14–19, 53–56) comprises bevel gears (79, 80);

rotary power transmission means (31, 25, 58, 60) coupled to said printing cylinder shaft (59) and to said motor (8) for transferring power from the individual drive motor (8–13) to said printing cylinder shaft;

rotary power transfer means (90, 91), coupled to said printing cylinder shaft (59), and wherein said means for selectively coupling or uncoupling the power take-off unit comprises a positive engagement clutch (72) selectively coupling together said rotary power transfer means (90, 91) and said right-angle drive transmission, for selectively transmitting rotary power and positioning information between said horizontal synchronizing shaft (21, 38) and the vertical synchronizing shaft (22, 23, 24) of a tower unit through said rotary power transfer means to the printing machine cylinder shaft (59), and to permit, selectively, transfer of rotary power from the individual drive motor (8–13) of any one unit only to the associated printing cylinder or, selectively and upon engagement of said clutch (72), between the associated printing cylinder and at least one of said drivingly coupled synchronizing shafts (21, 38; 22, 23, 24).

4. The system of claim 1, wherein the power take-off units (14–19; 53–56) each include rotary power transmission means (31, 25, 58, 60) coupled to said printing cylinder shaft (59) and, respectively, to the individual drive motor (8, 13) for transferring power from the individual drive motor to said printing cylinder shaft;

rotary power transfer means (90, 91) coupled to said printing cylinder shaft (59);

wherein said means for selectively coupling or uncoupling the power take-off unit comprises a positive engagement clutch (72) having a first clutch element (77) and a first clutch connection means (75) coupled to said rotary power transfer means and hence to said printing cylinder shaft (59), and a second clutch element (78) and a second clutch connection means (76);

wherein said right-angle drive transmission comprises at least two bevel gears (80, 81), one of said bevel gears (81) being coupled to said horizontal synchronizing shaft (21, 38, 57) and another one (80) of said bevel gears being coupled to the vertical synchronizing shaft (22, 23, 24), and a further gear means (79) being coupled to the second clutch connection means (76); and wherein all said bevel gears and the further gear means are in continuous meshing engagement.

5. The system of claim 4, wherein the further gear means is a bevel gear (79) in coupled engagement with one (80, 81) of said bevel gears.

6. The system of claim 1, further including coupling means (61–67) separating said horizontal synchronizing shaft (21, 38, 57) into shaft sections or portions (21, 21*a*, 21*a*').

7. The system of claim 1, further including coupling means (63, 63*a*, 64, 65) separating said vertical shaft (22, 23, 24) into shaft sections or portions (22*a*, 22*a*').

8. The system of claim 1, wherein said system comprises at least two tower printing stations;

two horizontal synchronizing shafts (21, 38) are provided, one forming a lower level synchronizing shaft (21), and coupled to the power take-off unit (14, 15, 16) of the lower units (1, 2, 3),and the other one (38) forming an upper horizontal synchronizing shaft (38) coupling together the power take-off units (17, 18, 19) of the upper printing units (4, 5, 6) and, additionally, coupled via the power take-off units (17, 18, 19) to the vertical synchronizing shafts (22, 23, 24).

9. The system of claim 8, wherein said horizontal and vertical synchronizing shafts (21, 38; 22, 23, 24) interconnect said printing units into an interconnected synchronized grid or loop.

10. In a rotary printing machine system having a plurality of synchronized printing machine units (1, 2, 3; 44–47), each of said units having a printing cylinder (20) carrying an image to be printed and a printing cylinder shaft (59) coupled to the printing cylinder;

an individual drive motor (8–13) associated with and coupled to a shaft (59) of an associated printing cylinder;

at least one horizontal synchronizing shaft (21, 38, 57) extending through the plurality of said printing machine units (1, 2, 3), said synchronizing shaft coupling the units together into a synchronized printing machine system, wherein each printing machine unit has an individual power take-off unit (14, 15, 16) directly associated therewith, said power take-off unit including vertical synchronizing shaft connection means (22*a*, 22*a*');

a right-angle drive transmission (14) having means (80, 81) for coupling the horizontal synchronizing shaft (21, 38) to the vertical synchronizing shaft connection means (22*a*) of the associated printing unit to permit synchronization of the respective lower printing unit with said vertical shaft connection means; and means (81–79; 72) for positively selectively coupling or uncoupling the individual drive motor of the respective unit, and hence the printing cylinder shaft (59) of the respective printing cylinder (20), to or from said right-angle drive transmission, and hence from both the horizontal synchronizing shaft (21, 38) as well as the vertical shaft connection means (22*a*, 22*a*') of the respective printing machine unit, whereby the vertical shaft connection means (22*a*, 22*a*') will be in continuous synchronous driving engagement with the horizontal synchronizing shaft (21), while permitting selective individual engagement or disengagement of the printing cylinder shaft (59) of any one printing cylinder, and the drive motor (8–13) coupled thereto of any one unit to or from the synchronized coordinate printing machine system; and wherein the power take-off units of the printing machine units of the printing machine system are essentially similar.

11. The system of claim 10, wherein the right-angle drive transmission of the power take-off units (14–19, 53–56) comprises bevel gears (79, 80);

rotary power transmission means (31, 25, 58, 60) coupled to said printing cylinder shaft (59) for transferring power from the individual drive motor (8–13) to said printing cylinder shaft;

rotary power transfer means (90, 91), coupled to said printing cylinder shaft (59), and wherein said means for selectively coupling or uncoupling the power take-off means comprises a positive engagement clutch (72) selectively coupling together said rotary power transfer means (90, 91) and said right-angle drive transmission, for selectively transmitting rotary power and positioning information between said horizontal synchronizing shaft (21, 38) and the vertical synchronizing shaft connection means (22*a*, 22*a*′) through said rotary power transfer means to the printing machine cylinder shaft (59), and to permit, selectively, transfer of rotary power from the individual drive motor (8–13) of any one unit only to the associated printing cylinder or, selectively and upon engagement of said clutch (72), between the associated printing cylinder and said selectively drivingly coupled synchronizing shafts (21, 38) or said vertical synchronizing shaft connection means (22*a*, 22*a*′).

12. The system of claim 11, including a further bevel gear (79) in coupled engagement with one (80, 81) of said bevel gears.

13. The system of claim 10, further including coupling means (61–67) separating said horizontal synchronizing shaft (21, 38, 57) into shaft sections or portions (21, 21*a*, 21*a*′).

* * * * *